US009127907B2

(12) United States Patent
Lupher et al.

(10) Patent No.: US 9,127,907 B2
(45) Date of Patent: Sep. 8, 2015

(54) PRECISION GUIDED FIREARM INCLUDING AN OPTICAL SCOPE CONFIGURED TO DETERMINE TIMING OF DISCHARGE

(71) Applicants: John Hancock Lupher, Austin, TX (US); Stefanie Kwan, Cedar Park, TX (US); Douglas Ainsworth Scott, Bracknell (GB); Michael Toal, Austin, TX (US)

(72) Inventors: John Hancock Lupher, Austin, TX (US); Stefanie Kwan, Cedar Park, TX (US); Douglas Ainsworth Scott, Bracknell (GB); Michael Toal, Austin, TX (US)

(73) Assignee: TrackingPoint, Inc., Pflugerville, TX (US)

( * ) Notice: Subject to any disclaimer, the term of this patent is extended or adjusted under 35 U.S.C. 154(b) by 74 days.

(21) Appl. No.: 13/913,351

(22) Filed: Jun. 7, 2013

(65) Prior Publication Data

US 2014/0360072 A1 Dec. 11, 2014

(51) Int. Cl.

| | |
|---|---|
| ***G06F 19/00*** | (2011.01) |
| ***F41G 3/00*** | (2006.01) |
| ***F41G 1/38*** | (2006.01) |
| ***F41G 3/12*** | (2006.01) |
| *F41G 3/06* | (2006.01) |
| *F41G 3/08* | (2006.01) |
| *F41G 3/16* | (2006.01) |

(52) U.S. Cl.
CPC .. *F41G 3/00* (2013.01); *F41G 1/38* (2013.01); *F41G 3/12* (2013.01); *F41G 3/06* (2013.01); *F41G 3/08* (2013.01); *F41G 3/165* (2013.01)

(58) Field of Classification Search
USPC ..... 235/400, 404, 407, 414, 417
IPC ..... F41J 5/06; F41G 3/06,5/14, 11/00; G05B 19/00; G06G 7/80, 7/32; G01C 3/00
See application file for complete search history.

(56) References Cited

U.S. PATENT DOCUMENTS

2006/0005447 A1 1/2006 Lenner et al.
2012/0037702 A1* 2/2012 Kude ..... 235/407

FOREIGN PATENT DOCUMENTS

SE 2001096854 8/2011

OTHER PUBLICATIONS

U.S. Appl. No. 13/913,351, European Search Report.

* cited by examiner

*Primary Examiner* — Karl Frech
(74) *Attorney, Agent, or Firm* — Cesari & Reed LLP; R. Michael Reed

(57) ABSTRACT

A precision guided firearm (PGF) includes a trigger assembly and an optical device coupled to the trigger assembly. The optical device is to predict a time when an aim point of the PGF is less than a programmable threshold distance from a selected location on a target and to control the trigger assembly to discharge the PGF at the time.

20 Claims, 4 Drawing Sheets

PRECISION GUIDED FIREARM INCLUDING AN OPTICAL SCOPE CONFIGURED TO DETERMINE TIMING OF DISCHARGE

FIELD

The present disclosure is generally related to small arms firearms, and more particularly to small arms firearms including an optical device configured to control timing of discharge of the small arms firearm.

BACKGROUND

When a user shoots a small arms firearm at a target at long range, small movements and/or user jitter may cause the aim point of the firearm to move relative to the target. Such movements may cause the aim point to be on target only briefly as the user attempts to control the aim point. Further, small changes in the minute of angle (MOA) relative to the target may cause a user to miss the target. At 1000 yards, a change of one MOA may cause the shooter to miss by as much as 10 inches.

A precision guided small arms firearm (PGF) is a weapon, such as a pistol, rifle, air gun, or other hand-held projectile-firing weapon that includes a controller configured to help the shooter hit a target. In the hands of different users, the characteristics of the movement of the firearm when directing the aim point of the firearm toward the selected target may vary significantly, making it difficult for the controller to enhance the shooter's accuracy.

SUMMARY

In an embodiment, a precision guided firearm (PGF) includes a trigger assembly and an optical device coupled to the trigger assembly. The optical device is configured to predict a time when an aim point of the PGF is less than a programmable threshold distance from a selected location on a target and to control the trigger assembly to discharge at the time.

In another embodiment, a method of controlling discharge of a precision guided firearm includes determining a distance between a selected location on a target and an aim point corresponding to a ballistic solution of the PGF using an optical scope coupled to the PGF. The method further includes controlling a trigger assembly of the PGF to discharge at a predicted time when the distance is less than a threshold.

In still another embodiment, an optical scope includes a trigger assembly interface configurable to couple to a trigger assembly of a firearm, an optical sensor configured to capture video of a view area, and a processor coupled to the trigger assembly interface and the optical sensor. The processor is configured to provide a control signal to the trigger assembly interface to control discharge of the firearm according to a predicted time when an aim point of the firearm is within a programmable distance from a selected location on a target.

BRIEF DESCRIPTION OF THE DRAWINGS

In the following discussion, the same reference numbers are used in the various embodiments to indicate the same or similar elements.

DETAILED DESCRIPTION OF ILLUSTRATIVE EMBODIMENTS

In the following detailed description of the embodiments, reference is made to the accompanying drawings which form a part hereof, and in which are shown by way of illustration of example embodiments. It is to be understood that features of the various described embodiments and examples may be combined, other embodiments may be utilized, and structural changes may be made without departing from the scope of the present disclosure.

Embodiments of a PGF are described below that includes a controller configured to control a trigger assembly to prevent discharge of a firearm until the aim point is within a threshold distance from a selected location on a target. Further, the controller is configured to process video frames to track movement of the aim point relative to the selected location on the target and to predict when the aim point of the PGF will be within a threshold distance from a selected location on a target. It should be appreciated that the trigger assembly of the firearm may introduce a mechanical delay between when the trigger is pulled and the firearm is discharged, and the prediction by the controller may account for this delay. In an embodiment, the controller may determine when the aim point will be at a closest distance ("closest approach") to a selected location on a target. The controller may predict the closest approach using only optical information or using optical and motion data. In a particular embodiment, the controller may control timing of the discharge of the PGF to correspond to when a distance between the aim point and the selected location on the target begins to increase. An example of a PGF according to an embodiment is described below.

Figure 1:
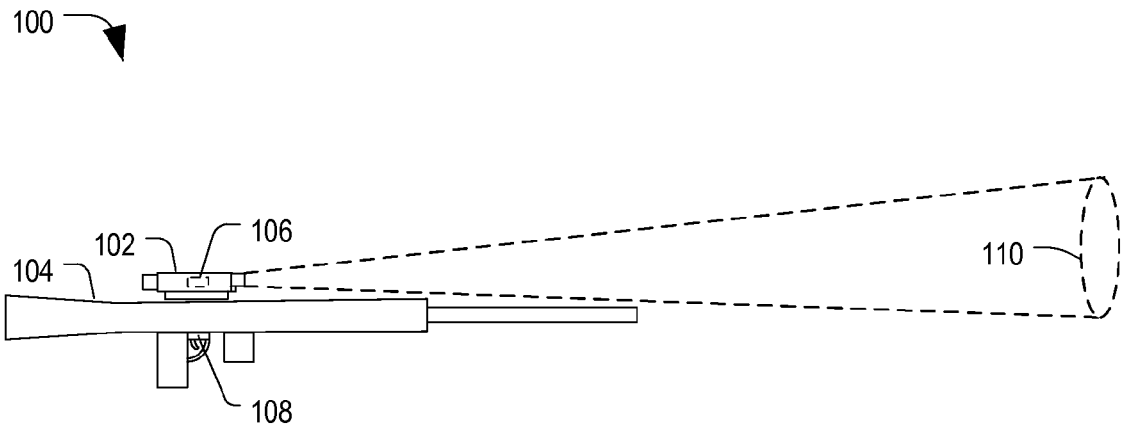
FIG. 1 is a diagram of a PGF according to an embodiment.

FIG. 1 is a diagram of a PGF 100 according to an embodiment. The PGF 100 includes an optical scope 102 mounted to a firearm 104. Optical scope 102 includes circuitry 106 that is communicatively coupled to a trigger assembly 108 through a wired or wireless connection to control timing of the discharge of firearm 104. Optical scope 102 includes optics coupled to optical sensors configured to capture video of a view area 110.

In an embodiment, the circuitry 106 may be configured to receive a user input indicating a selected target within view area 110. Upon receipt of the user input, circuitry 106 may apply a visual marker or tag on a selected location on the target in a display within optical scope 102, where the selected location to a visual aim point of the optical device at the time the user input is received. Upon selection of the target, circuitry 106 may also control a range finder, such as a laser range finder to determine a distance to the selected target. Upon determination of the distance, circuitry 106 may determine a ballistic solution for the selected target and adjust the display to show the portion of the view area corresponding to the ballistic solution. The ballistic solution may include bullet drop, windage, muzzle velocity, and other parameters that may affect the impact location of the bullet when the firearm is discharged. The resulting aim point corresponds to the ballistic solution. This means that the view area seen by the user in the display of the optical scope 102 may dramatically change, including a complete shift from even having the target within the view area, due to the implementation of the ballistic solution. Accordingly, once the ballistic solution is determined, the center of the display within optical scope 102 may shift to correspond to a calculated impact location for the bullet when the firearm is discharged.

Circuitry 106 may process each frame of video captured by optical sensors within optical scope 102 to determine changes in the aim point relative to the selected location on the target. Circuitry 106 may track the changes and predict when the aim point is within a pre-determined threshold (defining a minute of angle relative to the location on the selected target) and may control trigger assembly 108 to discharge when the aim point is within a threshold distance from the selected location. In an embodiment, circuitry 106 may predict when the aim point is at its closest approach. In a particular embodiment, the closest approach corresponds to the time when the trajectory of the aim point of the PGF 100 begins to move away from a position that is normal (perpendicular) to the selected location relative to the trajectory of the aim point. As defined herein, the term "aim point" refers to the ballistic solution of the PGF 100, and the terms "visual aim point" and "optical aim point" refer to the alignment of a reticle of the optical scope 102 relative to the view area 110 prior to target selection.

It should be understood that the optical scope captures video frames at a frame rate, such as 60 frames per second, 30 frames per second, or some other frame rate, and circuitry 106 processes the video frames to optically determine the trajectory of the aim point relative to the selected target. However, between frames, there exists a "black" area or "unknown" trajectory that may vary according to the user's movement. In an embodiment, circuitry 106 predicts the changes in trajectory between frames within those "black" areas. Since this particular approach relies on optical analysis of the video frames, the prediction is somewhat course because the frames may be captured several milliseconds apart. In another embodiment, circuitry 106 may use motion data from one or more motion sensors (such as gyroscopes, inclinometers, and accelerometers) to detect movement of the aim point during the "black" areas between frames, making it possible for circuitry 106 to predict when the aim point will be closest to the selected location on the target and to control timing of the discharge of the PGF 100 to fire at the appropriate time.

In general, human jitter and muscle movements when the user is aiming the PGF 100 may cause the aim point to move relative to the selected location on the target. At high magnification, such movements and jitter are magnified relative to the selected location on the target. One example depicting the changing aim point of the PGF 100 is described below with respect to FIG. 2.

Figure 2:
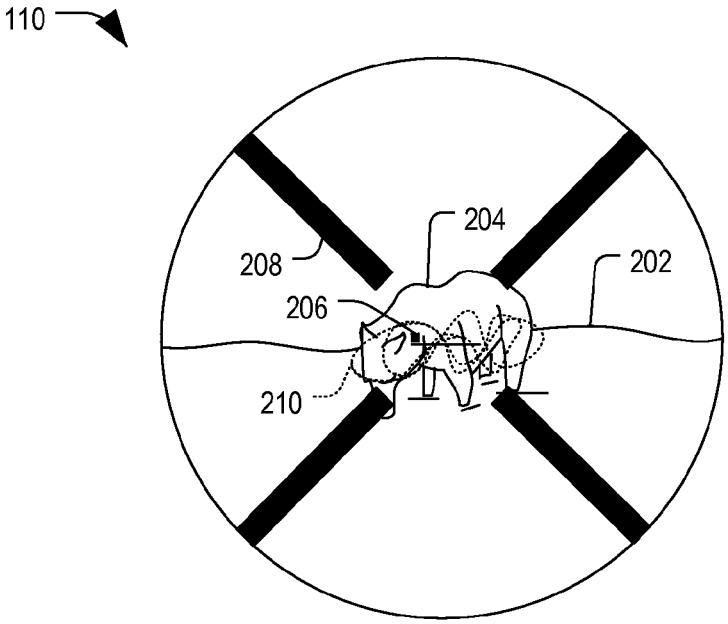
FIG. 2 is a diagram of a representative example of a view area of an optical scope of the PGF of FIG. 1.

FIG. 2 is a diagram of a representative example of a view area 110 of an optical scope 102 of the PGF 100 of FIG. 1. View area 110 includes a horizon 202 and a target 204 within view area 110. In this example, the user selected target 204, applying a visual marker 206 to the selected target 204 within a display of optical scope 102. View area 110 further includes a reticle 208, which shows the aim point of the optical scope 102. The change in the alignment of the center of the reticle or the aim point over time is represented by dashed line 210, which crosses back and forth over target 204 as the user attempts to aim PGF 100 at the selected location (represented by visual marker 206).

In an embodiment, the user selects the target, for example, by interacting with one or more buttons on the trigger assembly 108, on optical scope 102, or any combination thereof, while aiming PGF 100 toward the target. In response to a user input signal corresponding to the user's interaction, circuitry 106 applies visual marker 206 within a display of the optical scope 102. After application of the visual marker, optical scope 102 determines a distance to the selected location on the target (for example, using laser range finding circuitry) and calculates a ballistic solution, which may cause the optical scope to adjust the presentation of the view area in the display to align the center of the view area (and the corresponding reticle) to the ballistic solution, accounting for bullet drop and other factors. Thus, when the shooter directs the PGF 100 toward the target, the center of the reticle corresponds to the ballistic solution.

Circuitry 106 processes each video frame to monitor the changes in the aim point from one frame to the next. Optical scope 102 controls timing of the discharge of PGF 100, allowing discharge when the aim point is within a pre-determined threshold distance (where the distance corresponds to the minute of angle of error of the aim point of the target) from the selected location on the target (represented by visual marker 206). In an embodiment, circuitry 106 may predict when the aim point of optical scope 102 will be within the threshold distance (using optical data and optionally motion data) and may control trigger assembly 108 to discharge at the appropriate time. In a particular embodiment, circuitry 106 may predict when the distance between the aim point and the selected location on the target will be increasing relative to the selected location (represented by the visual marker 206) based on the trajectory of the aim point. By controlling trigger assembly to discharge when the aim point is about to move away from the selected location, the timing of firing of PGF 100 will correspond to a closest approach, ensuring that the PGF 100 fires when the aim point is as close as possible to the selected location on the target and within the "kill zone" before firing.

Figure 3:
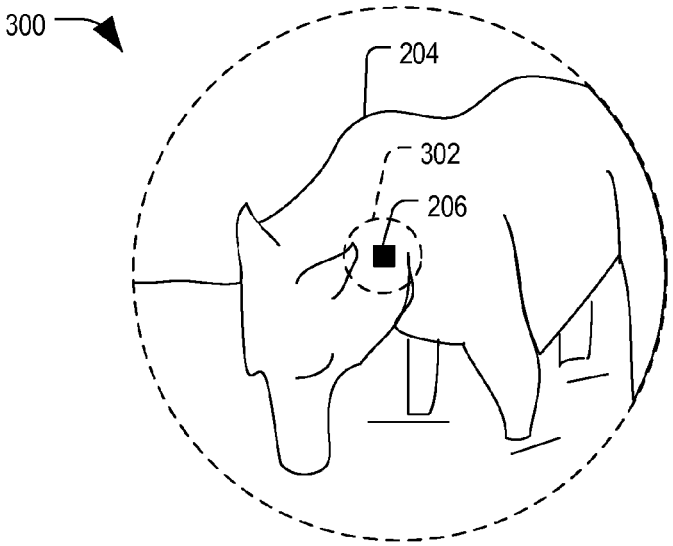
FIG. 3 is a diagram of an expanded portion of the view area of FIG. 2.

FIG. 3 is a diagram of an expanded portion 300 of the view area 110 of FIG. 2. Expanded portion 300 depicts target 204 and visual marker 206. Further, expanded portion 300 depicts a "kill area" or threshold distance 302 relative to visual marker 206 within which circuitry 106 of optical scope 102 will permit trigger assembly 108 to discharge PGF 100. In an embodiment, a default threshold distance 302 may be one minute of angle (MOA) at 1000 yards (where an MOA corresponds to a distance error of approximately one inch per hundred yards), and the user may adjust the threshold distance 302 from that default. The threshold distance 302 may be programmed by a user by interacting with a user interface of optical scope 102 or by interacting with an interface of a smart phone or other computing device configured to communicate with optical scope 102 through a wired or wireless communication link.

The threshold distance 302 may be defined in inches, centimeters, or minutes of angle. Further, optical scope 102 may be configured to adjust the threshold distance 302 based on the level of zoom of the optical scope 102 and the target 204. In particular, at higher levels of zoom, the optical scope 102 may utilize a smaller threshold to ensure accuracy at longer distances.

In an example, by controlling timing of the discharge of PGF 100 until the distance from the selected location is within the threshold distance 302, optical scope 102 prevents discharge of PGF 100 until the aim point is within an acceptable margin of error relative to the selected location on the target. In an embodiment, controller 106 may utilize a closest approach technique where circuitry 106 determines when the aim point (already within the threshold distance from the selected location on the target) is predicted to be increasing from a point that is normal to the selected location relative to the trajectory of the aim point of PGF 100, and circuit 106 controls trigger assembly 108 to discharge when the aim point of PGF 100 has reached its closest approach.

Figure 4:
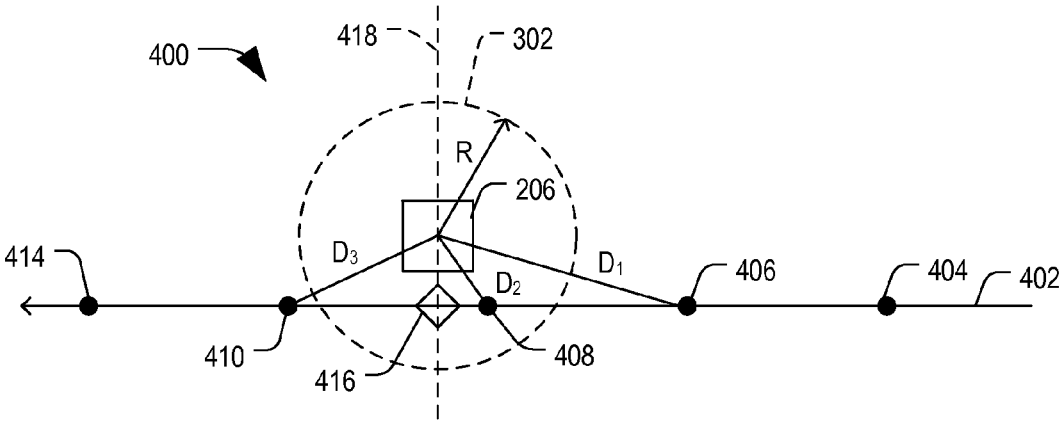
FIG. 4 is diagram of a representative example of a path of an aim point of the PGF of FIG. 1 as a user directs the aim point across a selected target.

FIG. 4 is diagram of a representative example 400 of a path 402 of an aim point of the PGF 100 of FIG. 1 as a user directs the aim point across a selected target. Example 400 includes visual marker 206 and threshold distance 302. Further, example 400 depicts visual samples 404, 406 408, 410, and 414, which are spaced substantially uniformly as the path 402 traverses the target. In this particular example, path 402 is a straight line, which passes through the area defined by threshold distance 302, which is defined by a radius (R). Circuit 106 may calculate a distance from each sample 404, 406, 408, and 410 to the selected location (visual marker 206). Distances from samples 406, 408, and 410 are generally depicted as $D_1$, $D_2$, and $D_3$, respectively. Further, circuitry 106 may calculate differences between the aim point distances from video frame to video frame to optically predict a trajectory of the aim point between video frames. In an embodiment, circuit 106 may predict when path 402 will intersect a point 416 that is normal to the selected location (visual marker 406) and within the threshold distance 302 based on the predicted optical trajectory. Circuit 106 may discharge PGF 100 just after path 402 crosses an axis 418 that extends in a y-direction through visual marker 206 and point 416.

It should be appreciated that the actual movement of the aim point relative to the selected target may vary and that the path 402 will almost certainly not be straight. Further, it should be appreciated that the distance between samples along the path 402 may vary, because the rate the change in the aim point may vary over time as the user continues to adjust his/her aim. Circuitry 106 may capture visual frames at a constant rate, but the velocity of the change in the aim point of PGF 100 and the directional vector of the aim point may vary over time.

In an embodiment, circuitry 106 may utilize motion data from one or more motion sensors to determine the actual trajectory of the aim point, making it possible for circuitry 106 to detect changes in the trajectory of the aim point during the periods between video frames. Circuitry 106 may use such information to determine a closest approach to the selected location and to control discharge of PGF 100 to correspond to the determined closest approach. As mentioned above, the trajectory of the aim point will vary over time. One possible example that depicts the changing direction of the aim point is described below with respect to FIG. 5.

Figure 5:
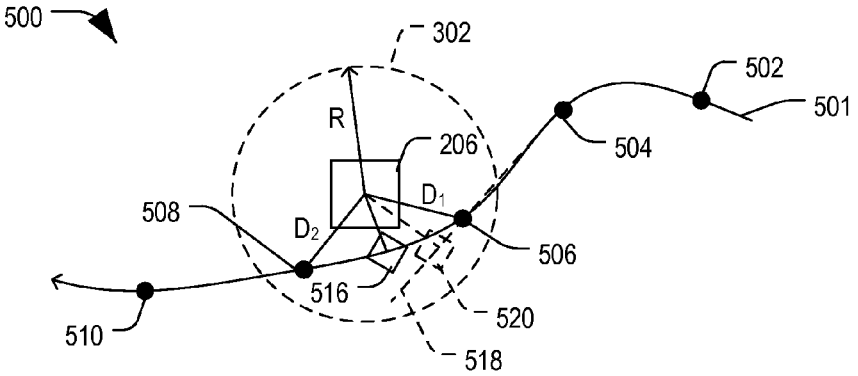
FIG. 5 is a diagram of a second representative example of a path of an aim point of the PGF of FIG. 1 as a user directs the aim point across a selected target.

FIG. 5 is a diagram of a second representative example 500 of a path 501 of an aim point of the PGF 100 of FIG. 1 as a user directs the aim point across a selected target. Example 500 includes visual marker 206 and threshold distance 302. Path 501 curves through the area defined by threshold distance 302, and circuit 106 processes video frames sampled at 502, 504, 506, 508, and 510. Samples 506 and 508 fall within threshold distance 302 from visual marker 206. If the visual data were sampled continuously, PGF 100 might discharge at point 516 along actual path 501. However, if circuit 106 were to predict the trajectory of path 502 relative to visual marker 206 based solely on a change in aim point from video frame 504 to video frame 506, which predicted path is shown in phantom at 518, circuit 106 would predict the closest approach to visual marker 206 to correspond to the point at 520 along the predicted optical path. Using motion data in conjunction with the optical data, circuitry 106 can more accurately determine the path 501 of the aim point.

It should be noted that, using the optical approach technique, circuit 106 may allow trigger assembly 108 to discharge PGF 100 at a point along aim path 501 that is between point 516 and predicted closest approach 520. By utilizing the closest approach in conjunction with the threshold distance 302, circuit 106 enhances the shooter's ability to hit a selected location on a target, even when the shooter is having difficulty holding the aim point of PGF 100 on the selected location 206 of the target. In an embodiment, when optical data and motion data are used to predict the aim point, circuitry 106 may control discharge of the firearm to correspond to a closest approach, which may correspond to a time when the aim point is predicted to be approaching, at, or just leaving a closest aim point location relative to the selected location on the target.

Figure 6:
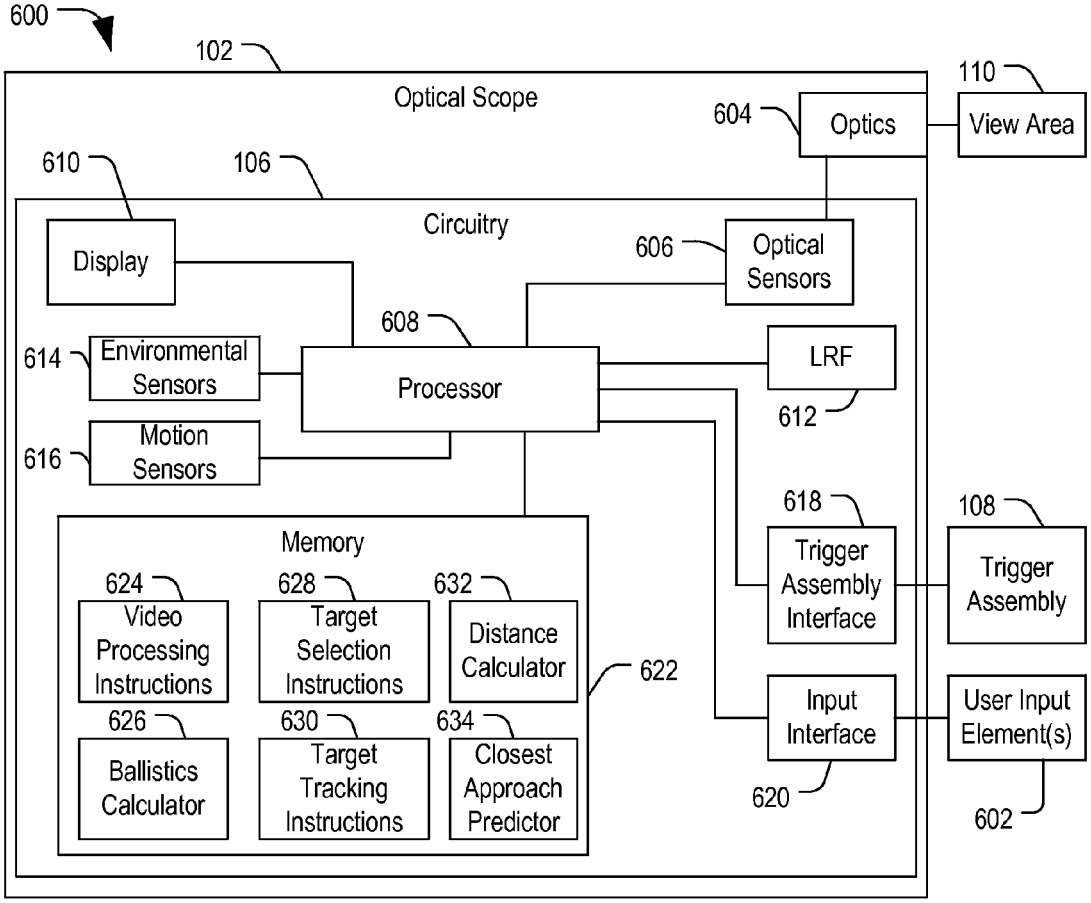
FIG. 6 is a block diagram of a PGF according to an embodiment.

FIG. 6 is a block diagram of a PGF 600 according to an embodiment. In an example, PGF 600 is one possible implementation of PGF 100 of FIG. 1. PGF 600 includes optical scope 102 including circuitry 106 coupled to trigger assembly 108. Further, circuitry 106 is coupled to user input elements 602 to receive user inputs.

Optical scope 102 includes optics 604 configured to focus light from view area 110 toward one or more optical sensors 606 of circuitry 106, which optical sensors 606 are configured to capture video of view area 110. Circuitry 106 includes a processor 608 coupled to optical sensor(s) 606. Circuitry 106 further includes a display 610 coupled to processor 608, which is configured to provide video to display 610. Circuitry 106 further includes a laser range finder (LRF) 612 coupled to processor 608. LRF 612 is controlled by processor 608 to direct a focused beam toward a selected target, and optical sensor 606 may receive a reflected version of the focused beam. Processor 608 or LRF 612 may calculate a distance to the selected target based on the reflected version of the focused beam.

Circuitry 106 further includes environmental sensors 614 coupled to processor 608, which environmental sensors 614 may be configured to measure temperature, humidity, air pressure, and other environmental parameters. Circuitry 106 also includes one or more motion sensors 616, including gyroscopes, accelerometers, inclinometers, and other sensors configured to detect mechanical motion of optical device 102. Further, circuitry 106 may include an altimeter and other sensors configured to determine the altitude at which optical scope 102 is being used.

Motion sensor(s) 616 are coupled to processor 608, which is also coupled to a memory 622. Circuitry 106 also includes a trigger assembly interface 618 coupled to processor 608 and coupled to trigger assembly 108 of a firearm to provide control signals to trigger assembly 108 to control timing of discharge of PGF 600. Circuitry 106 further includes an input interface 620 coupled to processor 608 and coupled to one or more user input elements 602, such as buttons or switches on trigger assembly 108, on a housing of optical scope 102, or any combination thereof. The user may interact with input elements 602 to adjust various parameters including, but not limited to, adjustments to the threshold distance, adjustments to various settings (such as wind speed and direction), adjustments to visual parameters, such as the shape and orientation of the reticles or the visual marker, and so on. Additionally, the user may interact with the input elements 602 to tag a target and/or adjust a zoom setting. Other parameters and user selection options may also be accessible through the input elements 602.

Memory 622 stores instructions that, when executed by processor 608, cause processor 608 to perform a variety of functions and operations. Memory 622 includes video processing instructions 624 that, when executed, cause processor 608 to process video frames from optical sensors 606 for presentation to display 610. Further, video processing instructions 624 cause processor 608 to determine the aim point of the optical device 102 relative to view area 110.

Memory 622 further stores a ballistics calculator 626 that, when executed, causes processor 608 to determine the aim point of PGF 600 based on environmental parameters from environmental sensors and based on the distance determined using LRF 612. Memory 622 also includes target selection instructions 628 that, when executed, cause processor 608 to receive user input from input interface 620 and to adjust one or more settings and/or select a target in response to the user input and to place a visual marker on a selected location on a target that corresponds to the user input. Memory 622 further includes target tracking instructions 630 that, when executed, cause processor 608 to maintain the visual marker at the selected location on the target within the video frames.

Memory 622 further includes a distance calculator 632 that, when executed, causes processor 608 to calculate an X-Y distance from the aim point in each video frame to the selected location on the target within the frame. Memory 622 also includes a closest approach predictor 634 that, when executed, causes processor 608 to determine a trajectory of a changing aim point by optically processing video frames and to predict a time when the trajectory will achieve a closest approach to the selected location on the target. Closest approach predictor 634 causes processor 608 to provide a control signal to trigger assembly 108 through trigger assembly interface 618 to control timing of the discharge of PGF 600 to correspond to the predicted time, such that PGF 600 discharges when the closest approach predictor 634 predicts that the aim path of optical scope 102 will cross a line normal to the visual marker 206 relative to the aim path.

In some embodiments, closest approach predictor 634 may utilize motion data from motion sensors 616 to determine when the aim point is within the threshold distance from the selected location on the target. In an embodiment, closest approach predictor 634 may cause processor 608 to determine when the aim point is about to reach or is beginning to move away from a closest distance to the selected location relative to the aim point trajectory. Closest approach predictor 634 may cause processor 608 to produce a control signal for communication to trigger assembly 108 to control timing of discharge of PGF 100 to correspond to a selected closest approach strategy. In one example, the user may configure PGF 100 to discharge when the aim point is predicted to be approaching, at, or just moving away from a closest point (relative to the selected location on the target) along the path of the aim point.

In an embodiment, processor 608 may adjust the timing based on detected changes in the velocity of the movement of optical scope 102 determined from motion sensors 616. As previously indicated, changes in the velocity of change of the aim point may alter timing of when the PGF 600 will reach the closest approach. Processor 608 may adjust the predicted timing based on such changes.

Figure 7:
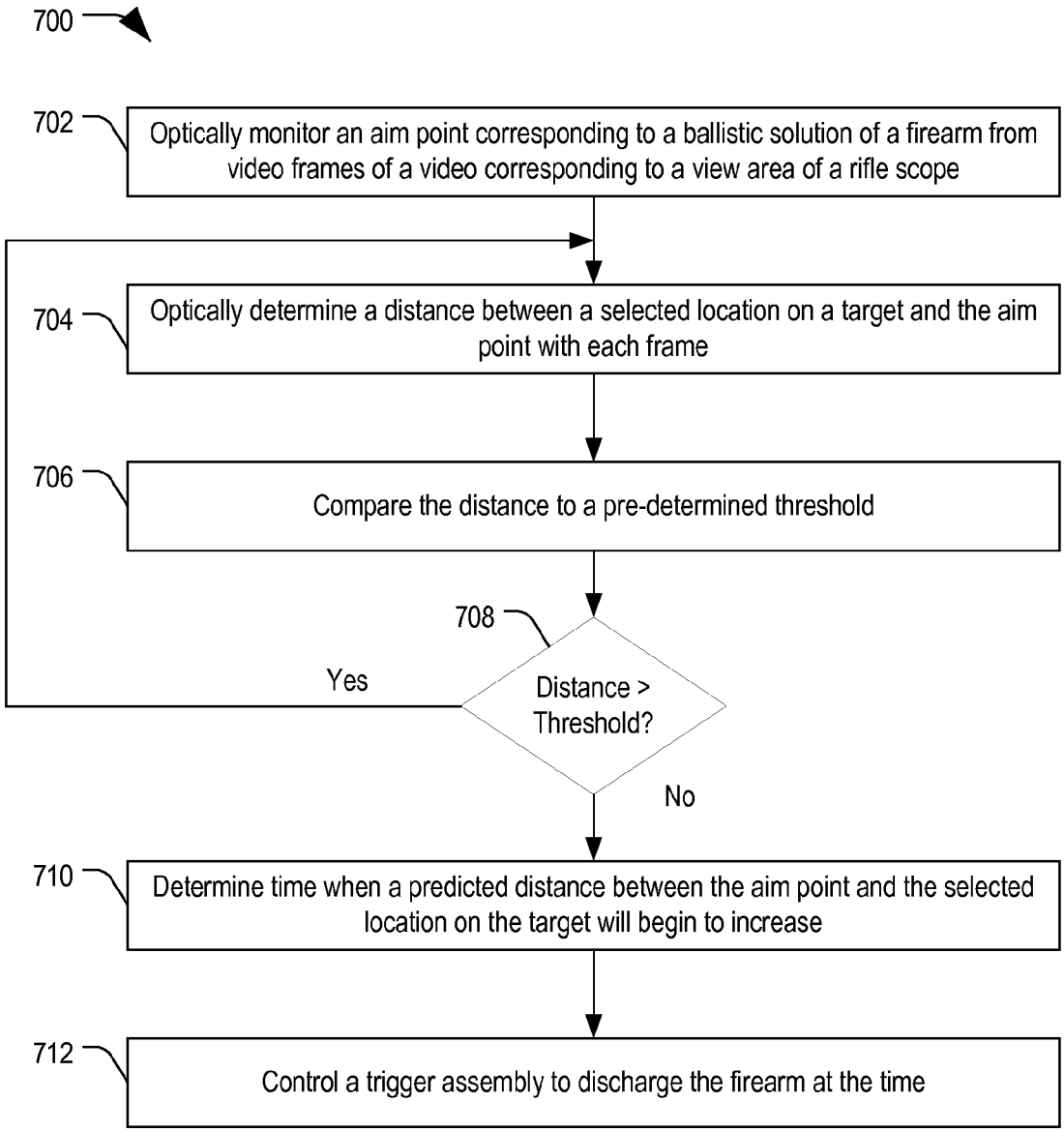
FIG. 7 is a flow diagram of a method of discharging a PGF in response to determining a closest approach.

FIG. 7 is a flow diagram of a method 700 of discharging a PGF in response to determining a closest approach. Method 700 assumes an optics only approach to determining the aim point. At 702, an optical scope 102 optically monitors an aim point corresponding to a ballistic solution of a firearm from video frames of a video corresponding to a view area of a rifle scope. Advancing to 704, optical scope 102 optically determines a distance between a selected location on a target and the aim point with each frame. Continuing to 706, optical scope 102 compares the distance to a pre-determined threshold. At 708, if the distance is greater than a threshold (which may define a minute of angle relative to the aim point of the PGF 100 or 600), the method 700 returns to 704 and the distance between the aim point in a next video frame is determined relative to the selected location on the target.

Returning to 708, if the distance is less than or equal to the threshold, the method 700 proceeds to 710 and optical device 102 determines a time when a predicted distance between the aim point and the selected location on the target will begin to increase. In an alternative example, the optical device may determine a time when the predicted distance will be at approximately a local minima. In this context, the term "approximately" refers to a point at or just after the local minima will be reached. In a particular example, circuitry 106 determines a trajectory of the aim point and predicts a time when the trajectory will cross a line that is normal to the trajectory and that intersects the selected location on the target. Continuing to 712, circuitry 106 controls trigger assembly 108 of PGF 100 or 600 to discharge the firearm at the predicted time.

In an alternative embodiment that uses motion data in addition to optical data, circuitry 106 may use the motion data to determine the aim point during periods of time between video frames. In such an example, circuitry 106 may control trigger assembly 108 to discharge PGF 600 at any time after the aim point is within the threshold distance from the selected location on the target and before the aim point exits the area corresponding to the selected location on the target. In a particular example, circuitry 106 may control discharge to correspond to a time when the aim point is within the threshold distance and when the aim point will be at a closest distance relative to the selected location on the target.

It is to be understood that, even though characteristics and advantages of the various embodiments have been set forth above, together with details of the structure and function of various embodiments, changes may be made in details, especially in the matters of structure and arrangement of parts within principles of the present disclosure to the full extent indicated by the broad meaning of the terms in which the appended claims are expressed. For example, while the description of PGF 600 includes an input interface 620 that is coupled to user selectable elements 602, such elements may be located on a housing of optical scope 102, on trigger assembly 108, or may be provided by a computing device (such as a portable computer, a tablet computer, a smart phone, and the like) that may communicate with input interface 620, or any combination thereof. Further, input interface 620 may include a wireless transceiver and/or a wired connection, such as a universal serial bus (USB) port to receive a connector associated with a computing device.

Further, the particular instruction sets may be combined into a single application or may be installed as modular instruction sets depending on the particular implementation for the PGF 600 while maintaining substantially the same functionality without departing from the scope and spirit of the disclosure. In addition, while the above-discussion focused on usage of a distance calculator to determine an optical distance between the aim point (corresponding to the ballistic solution of PGF 600) and a selected location on the target and usage of a closest approach predictor 634 to predict when the trajectory of the changing aim point will reach its closest approach, it is also possible to combine the distance calculator and predictor functions. It will be appreciated by those skilled in the art that the teachings disclosed herein can be carried out using measurements of velocity and changing acceleration from motion sensors and that timing of the prediction may include such measurements, effectively adjusting the timing of discharge of the firearm according to the measurements to account for a non-linear change in the velocity and direction of the aim point of PGF 600.

Although the present invention has been described with reference to preferred embodiments, workers skilled in the art will recognize that changes may be made in form and detail without departing from the scope of the invention.

What is claimed is:

1. A precision guided firearm (PGF) comprising:

a trigger assembly; and an optical device coupled to the trigger assembly, the optical device configured to predict a time when a distance between a ballistic solution of the PGF is less than a programmable threshold distance from a selected location on a target and when the distance will begin to increase, and further configured to control the trigger assembly to discharge the PGF at the time.

2. The PGF of claim 1, wherein the optical device determines the distance optically.

3. The PGF of claim 1, wherein the optical device determines the distance using optical data from one or more optical sensors and motion data from one or more motion sensors.

4. The PGF of claim 1, wherein the optical device comprises:

an optical sensor configured to capture video of a view area of the optical device; and a processor coupled to the trigger assembly and to the optical sensor, the processor configured to determine the ballistic solution of the PGF.

5. The PGF of claim 4, wherein the processor is configured to process video frames from the video to determine a change in the distance from video frame to video frame to determine the time.

6. The PGF of claim 1, wherein the optical interface includes an interface to receive user input corresponding to at least one of the selected location on the target and the programmable threshold distance.

7. The PGF of claim 1, wherein the programmable threshold distance corresponds to up to one inch of deviation per 100 yards relative to the selected location on the target.

8. The PGF of claim 1, wherein the optical device:

calculates the distance from the aim point to the selected location in video frames of the video;

determines a trajectory of the aim point from one video frame to a next video frame; and predicts when the distance will begin to increase based on the trajectory.

9. The PGF of claim 1, wherein the optical device determines the trajectory based on optical data from the video frames and based on motion data from one or more motion sensors corresponding to movement of the aim point during periods between the video frames.

10. A method of controlling discharge of a precision guided firearm (PGF), the method comprising:

determining a distance between a selected location on a target and an aim point corresponding to a ballistic solution of the PGF using an optical scope coupled to the PGF; and controlling a trigger assembly of the PGF to discharge at a predicted time when the distance is less than a threshold and when the distance is increasing.

11. The method of claim 10, wherein determining the distance comprises:

processing a sequence of video frames of a video captured by the optical scope;

determining a first distance from the aim point to the selected location on the target in a first video frame of the sequence of video frames;

determining a second distance from the aim point to the selected location on the target in a next video frame of the sequence of video frames;

determining a trajectory of the aim point based on a difference between the first distance and the second distance; and predicting the predicted time when the distance is increasing when the trajectory of the aim point will intersect a line normal to the trajectory that intersects the selected location.

12. The method of claim 11, wherein controlling the trigger assembly to discharge comprises controlling the trigger assembly to discharge when the distance is less than the threshold and the distance is at approximately a local minima.

13. The method of claim 10, wherein, prior to determining the distance, the method comprises receiving the threshold from an input interface, the threshold corresponding to up to one inch of deviation per 100 yards relative to the selected location on the target.

14. The method of claim 10, further comprising:

determining one or more changes in motion of the PGF from one or more motion sensors; and selectively adjusting the predicted time based on the one or more changes in motion of the PGF.

15. The method of claim 10, wherein determining the distance comprises processing a sequence of video frames to determine a trajectory of the aim point over time based on optical changes of the aim point from one video frame to a next video frame and motion data from one or more motion sensors.

16. The optical scope of claim 15, wherein the predicted time corresponds to when the aim point is moving away from a line that intersects the selected location and that is normal to the trajectory of the aim point.

17. An optical scope comprising:

a trigger assembly interface configurable to couple to a trigger assembly of a firearm;

an optical sensor configured to capture video of a view area; and a processor coupled to the trigger assembly interface and the optical sensor, the processor configured to process video frames of the video to determine a trajectory of an aim point of the firearm and to provide a control signal to the trigger assembly interface to control discharge of the firearm according to a predicted time when the aim point is within a programmable distance from a selected location on a target and when the distance will begin to increase.

18. The optical scope of claim 17, wherein the processor is configured to process video frames from the video to optically determine a change in distance between the aim point and the selected location on the target from video frame to video frame.

19. The optical scope of claim 17, wherein the processor is configured to determine the trajectory based on changes of the aim point from one video frame to a next video frame relative to the selected location.

20. The optical scope of claim 17, further comprising one or more motion sensors configured to determine motion data associated with the optical scope; and wherein the processor determines the predicted time based on optical data from the video frames and the motion data from the one or more motion sensors.

* * * * *